United States Patent [19]

Hewitt

[11] 3,951,596

[45] Apr. 20, 1976

[54] SOAP CURD DISPERSANT

[75] Inventor: Gordon Trent Hewitt, Upper Montclair, N.J.

[73] Assignee: Colgate-Palmolive Company, New York, N.Y.

[22] Filed: June 5, 1974

[21] Appl. No.: 476,521

Related U.S. Application Data

[62] Division of Ser. No. 297,194, Oct. 13, 1972, Pat. No. 3,843,543.

[52] U.S. Cl. ..... 8/137; 252/110; 252/117; 252/525; 252/544; 252/545

[51] Int. Cl.[2] ..... B08B 3/00; C11D 9/30

[58] Field of Search ..... 8/137, 142; 252/545, 252/153, 544, 525, 110, 117, 121, 356, 357, 118; 134/29

[56] References Cited

UNITED STATES PATENTS

| | | | |
|---|---|---|---|
| 2,383,738 | 9/1945 | Richardson et al. | 252/557 X |
| 2,527,076 | 10/1950 | Preston | 252/117 |
| 2,607,740 | 8/1952 | Vitale et al. | 252/548 |
| 2,733,213 | 1/1956 | Vitale | 252/525 X |
| 2,877,185 | 3/1959 | Krumrei et al. | 252/529 |
| 2,877,186 | 3/1959 | Krumrei | 252/DIG. 14 |
| 3,057,676 | 10/1962 | Wedell | 8/142 |
| 3,085,067 | 4/1963 | Anderson | 252/541 X |
| 3,179,599 | 4/1965 | Eaton et al. | 252/153 |
| 3,586,632 | 6/1971 | Hewitt | 252/117 |
| 3,629,122 | 12/1971 | Jakobi | 252/89 |
| 3,701,627 | 10/1972 | Grunewalder | 8/137 X |

*Primary Examiner*—Thomas J. Herbert, Jr.
*Attorney, Agent, or Firm*—Herbert S. Sylvester; Murray M. Grill; Kenneth A. Koch

[57] ABSTRACT

The disclosure relates to a soap curd dispersant in clear liquid form to be added to the laundry in either the wash cycle or the rinse cycle. The soap curd dispersant comprises a higher alkyl dimethyl amide or higher alkyl dimethyl sulfonamide, a hydrotrope, and an organic solvent.

7 Claims, No Drawings

SOAP CURD DISPERSANT

This is a divisional of application Ser. No. 297,194, filed Oct. 13, 1972, now U.S. Pat. No. 3,843,543.

BACKGROUND OF THE INVENTION

The present invention relates to soap curd dispersants which can be added in the rinse cycle or with the soap in the washing step.

The oldest, best known, and by far the most important surface active agents are soaps. The salient disadvantage of the soaps is their instability toward heavy-metal ions, particularly the calcium and magnesium found in hard water, as the calcium and magnesium salts of the fatty acids are quite insoluble in water. Soap, however, has at least two major points of superiority, i.e., low cost and high detergent powers in most of the cleaning operations encountered practically.

Fatty acid soaps in moderately hard water are known to provide excellent soil removal and very good suspension of soil in the wash cycle of laundering. However, in the subsequent step of rinsing, a smaller amount of residual soap, which cannot be totally extracted from the laundry items, comes in contact with a relatively large amount of hard water cations. This rinsing step can reprecipitate lime soap, carrying with it small but ultimately visible amounts of insoluble dirt and other "color bodies".

SUMMARY OF THE INVENTION

A particularly efficient soap curd dispersant has now been developed. The clear liquid soap curd dispersant can be added to the laundry, preferably in the rinse cycle, to prevent undesired interferences with the detergency of the soap from the hard water cations present in the rinse water. The same product can be added along with the soap in the washing step, but relatively more of the composition is required than if it is used just in the rinse water.

The soap curd dispersant of the present invention comprises a liquid higher alkyl dimethyl amide or higher alkyl dimethyl sulfonamide, a hydrotrope, an organic solvent, and water.

The amides which come within the scope of this invention are amides of higher fatty acids having the general formula:

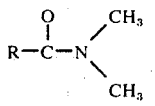

wherein R is oleic, isostearic, lauric, or myristic. The preferred amides are those of lauric acid and myristic acid.

Instead of amides of solely lauric acid or myristic acid as exemplified above, it is preferred to use the corresponding amides derived from mixtures of carboxylic acids. The amides may be derived from fatty acids of oils of the coconut oil group, a group of tropical nut oils characterized by their high content of lauric and myristic acids. Alternatively, the amides may be derived from carboxylic acids obtained from the oxidation of paraffin hydrocarbons, or petroleum, or obtained directly by hydrogenation of carbon monoxide (the Fischer-Tropsch process) or indirectly by oxidation of the saturated or unsaturated hydrocarbons or oxygenated hydrocarbons resulting from this process.

Where a mixture of lauric and myristic dimethyl amides is used, the amount of lauric dimethyl amide ranges from about 30% to about 70% by weight of the amide mixture, and is preferably about 50%.

The sulfonamides which may be employed in the soap curd dispersants of the present invention are the dimethyl higher alkyl sulfonamides, which are represented by the formula:

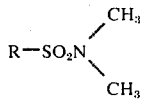

wheren R is a higher alkyl group containing 8 to 18 carbon atoms and preferably 12 to 18 carbon atoms. The R substituent is preferably derived from paraffin hydrocarbons, polymers of monoolefins, long chain fatty materials derived from coconut oil, tallow, myristic acid, lauric acid, stearic acid, and the like including mixtures thereof. Specific examples of sulfonamides are tetradecane or myristyl dimethyl sulfonamide, dodecane or lauryl dimethyl sulfonamide, octadecane or stearyl dimethyl sulfonamide, mixed saturated hydrocarbons of 12–18 carbons dimethyl sulfonamide, and the like. In the present invention, these polar nonionic compounds possess excellent curd dispersing properties and foam stabilizing properties with excellent sebum solubilizing power in spite of their relatively low solubility in aqueous solution.

These sulfonamide derivatives may be prepared in any suitable manner and numerous processes for their production are known in the art. A preferred sulfonamide material utilizes aliphatic paraffin cuts of about 10–18 carbons which can easily be prepared industrially, for example in petroleum fractions. The paraffin fraction is treated with sulfur dioxide and chlorine in the presence of ultra-violet light to form the sulfonyl chlorides, followed by treatment with dimethyl amine to form the corresponding higher alkyl dimethyl sulfonamides. The sulfonamides prepared by such known commercial methods are believed to consist of 90% monosubstituted and with usually a minor amount such as 10% disubstituted alkyl dimethyl sulfonamides. The location of these functional groups is not precisely known but is situated at random along the hydrophobe chain and the mixture functions well herein. Other ratios of substitution and other distributions of substituent position are possible with differing methods of preparation and lead to satisfactory products also.

The amides or sulfonamides are present in the soap curd dispersant formulations of the present invention in amounts ranging from about 10% to about 60%, with a preferred range being from about 20% to about 40%.

The inclusion of a water-soluble hydrotropic substance is effective in promoting the compatibility of the ingredients so as to form a homogenous liquid product. Suitable materials are the alkali metal organic sulfonated (including sulfated) salts having a lower alkyl group of up to about six carbon atoms. It is preferred to employ an alkyl aryl sulfonate having up to six carbon atoms in the lower alkyl group such as the sodium and potassium xylene, toluene, ethylbenzene, and isopropyl benzene sulfonates. Sulfonates made from xylene include orthoxylene sulfonates, metaxylene sulfonate, paraxylene sulfonate, and ethylbenzene sulfonate as the main ingredient. Analyses of typical commercial products show about 40–50% metaxylene sulfonate, 10–35% orthoxylene sulfonate, and 15–30% paraxylene sulfonate, with 0–20% ethylbenzene sulfonate. Any suitable isomeric mixture may be employed, however. Sodium and potassium alkyl naphthalene sulfonates having up to six carbon atoms in the lower alkyl group may also be used. Suitable lower alkyl sulfate salts having about five to six carbon atoms in the alkyl group may be employed also, such as the alkali metal n-amyl and n-hexyl sulfates. The hydrotropic materials are employed generally in amounts ranging from about 5% to about 25% by weight of the composition, and preferably in amounts ranging from about 10% to about 15%.

Organic solvents are present in the soap curd dispersants of the present invention to work in conjunction with the hydrotrope in solubilizing the active ingredient. The organic solvents help to impart a clear, readily-flowing property to the soap curd dispersants of the present invention. Among the organic solvents found to be particularly beneficial in the formulations of the present invention are ethanol, propanol, isopropanol, propylene glycol, and the like. The solvents provide for improved physical properties such as a lower cloud point, improved low temperature aging, modified viscosity, and the like. The suitable amount of solvent which may be employed varies with the particular formulation, as an excessive amount tends to result in separation of the product into two or more phases. The organic solvents are generally present in amounts ranging from about 5% to about 25%, and preferably from about 10% to about 15%.

Where a more viscous liquid soap curd dispersant is desired, it is possible to add a synthetic polymer type anti-redeposition agent to the formulation. Sodium carboxymethylcellulose is by far the best known and most widely used anti-redeposition agent; it usually has a substitution value of 0.6 to 0.7, i.e., approximately two etherified hydroxyl groups are present for every three anhydroglucose units. Many other hydrophilic colloids, particularly those which are polyelectrolytes, are useful as soil-suspending agents in the soap curd dispersant formulations of the present invention. The alginates, Irish Moss and the various vegetable gums have a valuable soil-suspending action. Carboxyethylcellulose, prepared by adding acrylonitrile to alkali cellulose and hydrolyzing the nitrile group, has been found useful as a soil-suspending agent, as well as several other cellulose derivatives which are known to be emulsifying agents and protective colloids as well. Among these materials are sulfoethylcellulose (made by adding vinylsulfonic acid to alkali cellulose), hydroxyethyl cellulose, and methylcellulose. Carboxymethyl ethers of starch as well as the water-soluble methyl and hydroxyethyl ethers of starch can also be used as soil-suspending agents in the formulations of the present invention. Carboxymethyl starch can be prepared by treating starch with chloroacetic acid and sodium hydroxide in aqueous methanol. Polyvinyl alcohols, polyvinylpyrrolidones, and polyethylene glycols are among the synthetic polymers useful as anti-redeposition agents in the present formulations. Polyvinylpyrrolidones of molecular weight of 15,000 to 40,000 are very effective, whereas the higher polymers of molecular weight of 25,000 and upwards have very little soil-suspending action. Polyethylene glycols of molecular weight of 6000 or higher are very effective, although the soil-suspending effect decreases with decrease in the molecular weight. Among the polyvinyl alcohols the products of lower molecular weight and lower degree of hydrolysis (77% hydrolyzed from the polyvinylacetate starting material) are much more effective soil-suspending agents than the high molecular weight, fully hydrolyzed materials.

Various adjuvant materials may be added to the soap curd dispersants of the present invention, such as optical brighteners, bleaches, germicides, fungicides, bactericides, colorants, perfumes, etc. which do not interfere with the curd-dispersing properties of the formulation.

The composition described herein is particularly low in foaming in the presence of soap, which is desirable in a laundry rinse cycle. A much lower level of soap and dispersant is required by introducing it into the rinse cycle rather than in the wash cycle. By incorporating the curd dispersant as a liquid rinse cycle additive, it is possible to utilize curd dispersant ingredients which would not be physically compatible with spray-dried laundry compositions. Additionally, the relative amount of curd dispersant can be varied to suit the hardness level of the water.

The instant soap curd dispersants have been found to be effective when used in the rinse cycle after washing with any type of soap, including mixtures of fatty acid soaps. The water-soluble soaps such as sodium, potassium, and other suitable alkali metal or ammonium soaps which may be prepared from tallow, hydrogenated tallow, coconut oil and hydrogenated coconut oil, cottonseed oil, soybean oil, corn oil, olive oil, palm oil, peanut oil, and the like. These soaps usually comprise the water-soluble salts of higher fatty acids of about 12 to 18 carbon atoms.

DESCRIPTION OF THE PREFERRED EMBODIMENTS

The present invention is more fully described and exemplified in the following examples. It is to be understood, however, that the invention is not limited to any specific form of materials or conditions set forth in the examples, but is limited solely by the appended claims.

EXAMPLE I

A soap curd dispersant was forulated from the following ingredients:

| | Percent by Weight |
|---|---|
| Lauric/myristic dimethyl amide (about 50% lauric/50% myristic by weight) | 30.0 |
| Sodium xylene sulfonate | 12.0 |
| Propylene glycol | 12.0 |
| Water | 46.0 |

The soap curd dispersant as prepared above is a clear, low viscosity liquid which mixes well with cool water.

When laundry was washed in hard water with coconut/tallow fatty acid soap, without the curd dispersant the rinse water exhibited a floating scum, presumably lime soaps. When one fluid ounce of the soap curd dispersant as prepared above was added to the rinse water, the rinse water exhibited a slight turbidity, no floating or precipitating lime soaps, and no foam. The clothes washed using the soap curd dispersant in the rinse water were soft-feeling and appeared very clean.

The composition as prepared above functioned well when added along with the soap powder in the washing cycle, although when added with the soap powder two fluid ounces of the soap curd dispersant was required.

Use of the soap curd dispersant as prepared above was tested and compared with using a conventional high-phosphate detergent. Eight pounds of clean, white laundry items were washed for ten minutes in a home washing machine using water of 100 ppm. at 120°F. The clothes were rinsed and air dried. The formulations used were as follows:

A. 0.18% Soap (sodium tallow/coconut fatty acids)

B. 0.18% Soap + 30 grams soap curd dispersants of Example I in rinse water

C. 0.18% Soap + 60 grams soap curd dispersant of Example I in wash cycle

D. 0.18% Detergent [10% anionic linear alkylbenzene sulfonate/2% ethoxyamer of synthetic fatty alcohol/2% soap (sodium tallow/coconut fatty acids)/35% sodium tripolyphosphate)].

A panel evaluated the whiteness and softness of the laundry items washed with the above-described formulations. A summary of the results of five washings is tabulated below:

| | Whiteness Preference | | | | |
|---|---|---|---|---|---|
| Wash No. | Preferred A | Preferred B | Preferred C | Preferred D | No Preference |
| 1 | 10 | 33 | 9 | 45 | 3 |
| 3 | 4 | 32 | 24 | 35 | 2 |
| 5 | 11 | 27 | 33 | 24 | 5 |

| | Softness Preference | | | | |
|---|---|---|---|---|---|
| Wash No. | Preferred A | Preferred B | Preferred C | Preferred D | No Preference |
| 1 | 34 | 20 | 24 | 5 | 17 |
| 3 | 46 | 24 | 16 | 2 | 12 |
| 5 | 44 | 17 | 15 | 3 | 21 |

It can be seen that the soap curd dispersants of the present invention contribute to the visual whiteness of laundry washed with soap, although there was no contribution to the softness of items washed with soap. However, the softness of the items washed with soap plus the soap curd dispersant were softer than those washed with a high-phosphate synthetic detergent.

EXAMPLE II

A soap curd dispersant is prepared from the following ingredients:

| | Percent by Weight |
|---|---|
| Lauric/myristic dimethyl amide (about 50% lauric/50% myristic by weight) | 30.0 |
| Sodium cumene sulfonate | 12.0 |
| Isopropanol | 10.0 |
| Optical Brighteners | 1.0 |
| Water | 47.0 |

EXAMPLE III

A soap curd dispersant for use in the rinse cycle can be formulated as follows:

| | Percent by Weight |
|---|---|
| Lauric/myristic dimethyl amide (about 50% lauric/50 myristic by weight) | 25.0 |

-continued

| | Percent by Weight |
|---|---|
| Sodium benzene sulfonate | 15.0 |
| Ethanol | 15.0 |
| Carboxymethylcellulose | 1.0 |
| Water | 44.0 |

EXAMPLE IV

A soap curd dispersant for use in the rinse cycle can be formulated as follows:

| | Percent by Weight |
|---|---|
| Lauric/myristic dimethyl amide (about 50% lauric/50% myristic by weight) | 25.0 |
| Sodium xylene sulfonate | 15.0 |
| Propylene glycol | 15.0 |
| Carboxymethylcellulose | 1.5 |
| Optical Brighteners | 1.0 |
| Water | 42.5 |

The instant soap curd dispersant, when used solely with laundry soap, is essentially free of the phosphates commonly used in the prior art. The sewage effluent thus does not contribute plant nutrient phosphates conducive to algae growth and the contamination of surrounding waters.

The instant soap curd dispersant disperses the lime soap precipitated in the rinse cycle when a small amount of residual soap is contacted with a relatively large amount of hard water cations. This dispersion prevents the reprecipitation of lime soap, which carries with it small but visible amounts of insoluble dirt, and results in a cleaner wash.

What is claimed is:

1. A method of washing fabrics using soaps of higher fatty acids comprising adding to the wash or rinse water a liquid soap curd dispersant comprising from about 10 to about 60 percent of an amide selected from the group consisting of oleic dimethyl amide, isostearic dimethyl amide, lauric dimethyl amide, myristic dimethyl amide, higher alkyl dimethyl sulfonamides wherein the alkyl group contains from 8–18 carbons, and mixtures thereof; from about 5 to about 25 percent of a hydrotrope, said hydrotrope being selected from the group consisting of sodium and potassium xylene sulfonates, cumene sulfonates, benzene sulfonates, ethylbenzene sulfonates, alkyl naphthalene sulfonates wherein the alkyl group contains from 1–6 carbon atoms; from about 5 to about 25 percent of an organic solvent, the balance of said soap curd dispersant being water.

2. The method of claim 1 wherein said organic solvent is chosen from the group consisting of ethanol, isopropanol and propylene glycol.

3. The method of claim 1 wherein said soap curd dispersant is added to the rinse water.

4. The method of claim 1 wherein the amide is a mixture of lauric dimethyl amide and myristic dimethyl amide.

5. The method of claim 1 wherein the ratio of lauric dimethyl amide to myristic dimethyl amide ranges from about 7:3 to about 3:7.

6. The method of claim 5 wherein the ratio of lauric dimethylamide to myristic dimethyl amide is about 1:1, the hydrotrope is sodium xylene sulfonate, and the organic solvent is propylene glycol.

7. The method of claim 1 wherein the soap curd dispersant contains an antiredeposition agent.

* * * * *